United States Patent [19]

Glenn et al.

[11] 4,429,200

[45] Jan. 31, 1984

[54] LOW COST, HIGH PERFORMANCE SWITCH ASSEMBLY

[75] Inventors: Robert L. Glenn, Arab; Jackson H. Smith, Union Grove, both of Ala.

[73] Assignee: Eaton Corporation, Cleveland, Ohio

[21] Appl. No.: 430,649

[22] Filed: Sep. 30, 1982

[51] Int. Cl.[3] ..... H01H 9/02

[52] U.S. Cl. ..... 200/153 T; 200/339; 200/332; 200/293

[58] Field of Search ..... 200/153 T, 332, 335, 200/339, 293

[56] References Cited

U.S. PATENT DOCUMENTS

| | | | |
|---|---|---|---|
| 2,547,765 | 4/1951 | Lund | 200/335 |
| 3,198,925 | 8/1965 | Starrantino | 200/332 |
| 3,377,454 | 4/1968 | Faggiano | 200/295 |
| 3,663,781 | 5/1972 | Zimmerman et al. | 200/153 T X |
| 3,749,873 | 7/1973 | Harper | 200/293 |
| 3,774,000 | 11/1973 | Beer | 200/335 |
| 3,805,008 | 4/1974 | Kessler et al. | 200/332 |
| 3,867,591 | 2/1975 | Nordeen | 200/52 R |
| 4,136,270 | 1/1979 | Wernet et al. | 200/340 |
| 4,145,590 | 3/1979 | Repplinger | 200/153 T X |
| 4,215,257 | 7/1980 | Repplinger | 200/153 T |

FOREIGN PATENT DOCUMENTS

| | | | |
|---|---|---|---|
| 1241893 | 6/1967 | Fed. Rep. of Germany | 200/153 T |
| 564253 | 7/1975 | Switzerland | 200/339 |
| 1259356 | 1/1972 | United Kingdom | 200/339 |

*Primary Examiner*—John W. Shepperd
*Assistant Examiner*—Renee S. Kidorf
*Attorney, Agent, or Firm*—C. H. Grace; L. G. Vande Zande

[57] ABSTRACT

A switch assembly incorporates miniature snap action switches (8) disposed over pins (26,28;56) molded integrally with a base member (6;52) and are held thereto by an enclosing case (4;50) to which the switch and base subassembly is snap-fit. A rocker actuator for the switches (8) is molded integrally with the base in one embodiment to have flexible wings (31) deformable to effect switch plunger (10) depression. In another version, a separate actuator (54) is pivotally supported by grooves (76) in the case (50) and the upper edge (60) of the base (52). The case is provided with serrated, variable panel thickness mounting structures (40;74) for snap-in attachment of the switch assembly in a panel opening.

12 Claims, 7 Drawing Figures

LOW COST, HIGH PERFORMANCE SWITCH ASSEMBLY

BACKGROUND OF THE INVENTION

This invention relates to electrical switch assemblies which utilize self-contained switch units as contact assemblies within switch housing and actuator superstructures. In particular, this invention relates to switch assemblies of the aforementioned type which employ miniature precision snap-action switches such as those described in A. W. Krieger U.S. Pat. No. 3,415,962, issued Dec. 10, 1968, and assigned by mesne Assignments to the assignee of this invention, to provide high quality contact assemblies for switch assemblies having low cost, small size and high performance requirements. Such switch assemblies may also require a particular type of actuator operation as-well-as specific mounting and appearance requirements for the housing. In order to satisfy the low cost parameter, the switch assemblies must comprise a minimum number of distinct parts and require simple and few assembly operations.

SUMMARY OF THE INVENTION

This invention provides an electrical switch assembly wherein a pair of snap action switches are utilized as contact assemblies in a housing superstructure comprising a one piece molded base and switch mounting member which receives and positions the snap action switches on the base, positions an actuator to overlie the switch operators, and which in turn is snapfit into an enclosing case which has an adjustable thickness press-in panel mounting structure formed thereon. The actuator may be a separate, pivotally mounted member or may be molded integrally with the base and comprises substantially planar laterally extending wings displaceable from their normal position for engaging the snap action switch operators to operate the respective switch contacts. The invention and its advantages will become more apparent in the following description and claims when read in conjunction with the accompanying drawings.

DESCRIPTION OF THE PREFERRED EMBODIMENT

Figure 1:
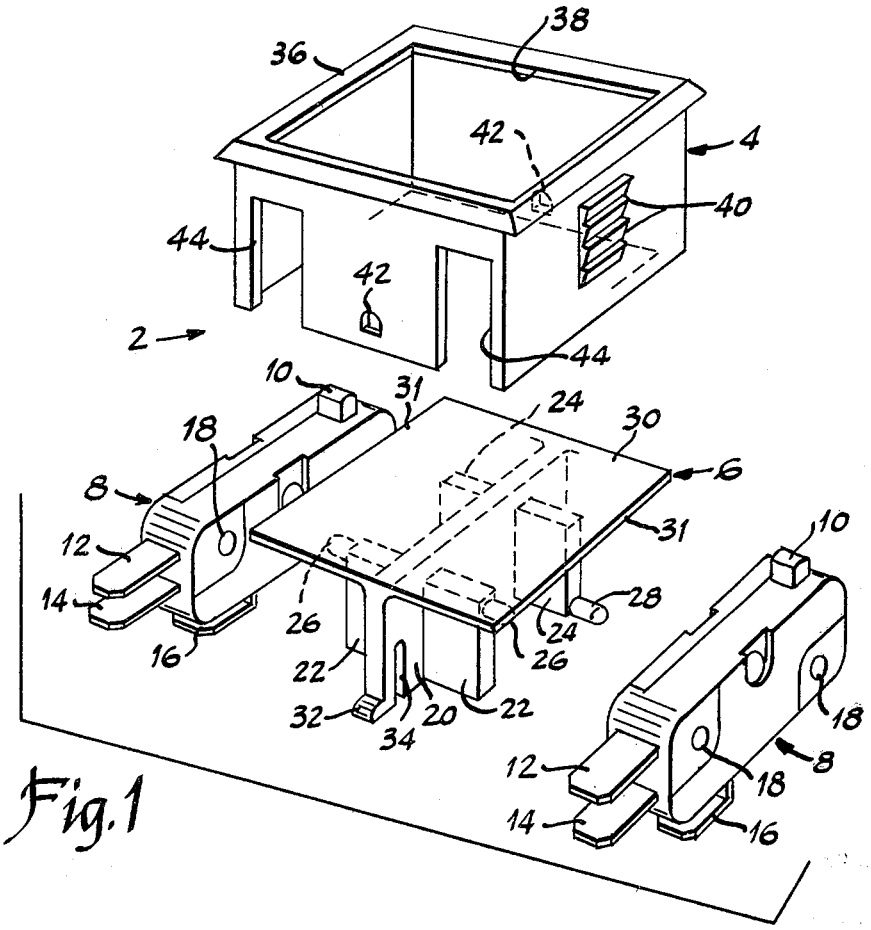
FIG. 1 is an exploded perspective view of a switch assembly constructed in accordance with this invention.

A first embodiment of the switch assembly 2 of this invention is shown unassembled in FIG. 1 and may be seen to comprise four components; an enclosing case 4, a combined base and actuator member 6 and two miniature precision snap action switches 8. The switches 8 are physically small, low cost devices having high electrical life and electrical capacity ratings and may for example be Cutler-Hammer Snap Action Switches manufactured under catalog number SS12ET31 by Eaton Corporation. The switches 8 each comprise a molded rectangular insulating housing which has a depressible plunger operator 10 extending upwardly at one end thereof and a plurality of electrical terminals 12, 14, and 16 arranged at an opposite end thereof. The insulating housing of each switch 8 is also provided with a pair of mounting holes 18 which extend transversely through the housing.

The combination base and actuator member 6 may be seen to comprise an upstanding rib 20 having transversely aligned pairs of ribs 22 and 24 projecting laterally therefrom at right angles. The outer surfaces of ribs 22 and 24 are provided with cylindrical pins 26 and 28, respectively, the pins 26 being located near the upper end of ribs 22 and the pins 28 being located adjacent the bottom edges of ribs 24 to be in alignment with the mounting holes 18 in the switches 8. An actuator portion 30 is integrally molded along the longitudinally extending upper edge of rib 20 and comprises a pair of wings 31 projecting laterally outwardly in opposite directions from the rib 20 to form a substantially planar surface of essentially rectangular dimensions. Actuator wings 31 have a narrower material thickness than the ribs 20, 22 and 24 and are spaced above the upper edges of transverse ribs 22 and 24. Combination base and actuator member 6 is molded as an integral, one piece member preferably made of Type 66 nylon material which is easily molded, durable, economical and available in various colors. The wings 31 of actuator portion 30 are resilient due to their thin cross-sectional thickness and may be elastically deflected in the lateral dimension by pressure applied from the upper surface, but return to their original position upon removal of such pressure. The opposite longitudinal ends of central rib 20 are provided with outwardly extending latches 32 which may be elastically displaced inwardly by virtue of a groove 34 molded in the rib 20 in back of latches 32.

Enclosing case 4 is a molded rectangular member having four relatively thin sidewalls open to the bottom of the enclosing case. The upper end of enclosing case 4 is provided with a bezel 36 which extends outwardly from the sides of the enclosing case to provide an overhanging peripheral flange. The bezel 36 defines a rectangular interior opening 38 along the top of the enclosing case 4. A plurality of projecting serrations 40 are molded on one pair of opposed sidewalls of enclosing case 4 and cooperate with the overhanging flange of bezel 36 to provide a variable thickness panel mounting means for the enclosing case. The opposite pair of opposed sidewalls of enclosing case 4 are provided with centrally located openings 42 near the bottom edge of the enclosing case to cooperate with latches 32 as will be described hereinafter. As viewed in FIG. 1, one wall of enclosing case 4 having an opening 42 is also provided with a pair of rectangular slots 44 open to the bottom to provide clearance for the terminals 12 and 14 of the respective switch units 8. Enclosing case 4 is also preferably molded of Type 66 nylon which enables the sidewalls to be elastically deformed during assembly and permits elastic deformation of the serrations 40 when the completed switch assembly is assembled to a panel to trap the panel between the bezel 36 and one of the serrations 40 in a known manner.

Figure 2:
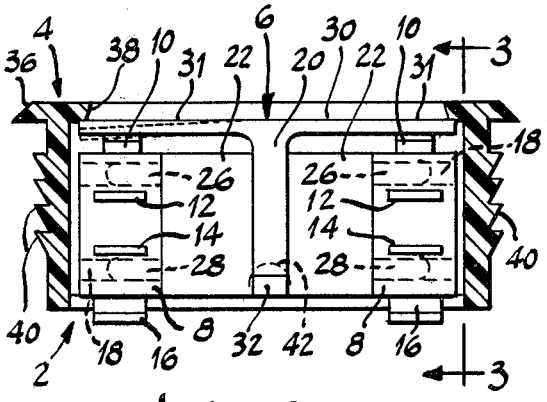
FIG. 2 is a sectional view through the assembled switch of FIG. 1 taken generally along the line 2—2 of FIG. 3.
Figure 3:
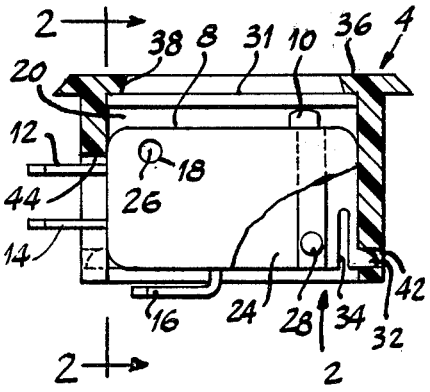
FIG. 3 is a sectional view of the switch assembly of FIG. 1 taken generally along the line 3—3 in FIG. 2.

The switch assembly 2 is assembled by aligning the openings 18 of the switch units 8 with the respective pins 26 and 28 of the molded base and actuator member 6 and pressing the switches firmly against the outer faces of transverse ribs 22 and 24. The pins 26 and 28 preferably have a diameter which is slightly larger than the openings 18 to present an interference fit therebetween, thereby to hold the switches 8 firmly assembled to the base and actuator member 6 during handling of this subassembly prior to its insertion in the enclosing case 4. This subassembly and enclosing case 4 are brought together through the open bottom of the enclosing case such that the latches 32 are in alignment with the opposed sides containing the openings 42 and the terminals 12 and 14 of switches 8 are aligned within the slots 44. It may be seen that the upper surfaces of latches 32 are provided with a rounded, somewhat angled edge so as to be cammed inwardly when this edge engages the bottom of the respective sidewalls of the enclosing case 4. As mentioned earlier, the enclosing case 4 itself is resilient and these walls will be elastically deflected outwardly by the cammed surface on the latches 32. The subassembly is inserted until the latches 32 align with the openings 42 and snap into position within the openings 42 to secure the base, actuator and switch assembly within the enclosing case 4. As seen in FIG. 2, the lateral clearance between the respective switches 8 and the interior of the sidewalls of the enclosing case 4 is considerably less than the length of the pins 26 and 28, and enclosing case 4 thereby serves to retain the switches 8 assembled to the base and actuator member 6. When thus assembled, the flat actuator portion 30 lies immediately adjacent the bezel portion 36 of the enclosing case 4 and completely closes the opening 38 in the upper surface of the case. By pressing downward on a wing 31 of actuator portion 30 at either side of the rib 22, the outer end of the actuator portion 30 is elastically deflected to depress the plunger 10 of the respective switch 8, thereby actuating the switch. The actuator portion 30 returns to its normal condition upon removal of the downward pressure, thereby permitting the operator 10 of the switch to return and deactuate the switch contacts.

An alternative embodiment of the switch assembly of this invention is illustrated in FIGS. 4–7, and may be seen to comprise an enclosing case 50, and base 52, a separate actuator 54 and two snap action switches identical to those earlier described and therefor also identified by the same reference numeral 8. The base 52 is a rectangular block preferably molded of the aforementioned Type 66 nylon. Pairs of cylindrical pins 56 are molded integrally with the base 52 to project laterally outwardly from the opposite sides of the base in corresponding alignment with the mounting holes 18 of switches 8. The base 52 has vertically oriented splines 58 formed on the ends thereof and a shallow longitudinally extending groove 60 formed in the upper edge thereof. The lower end portions of the splines 58 have ramp shaped catches 62 formed thereon.

Figure 4:
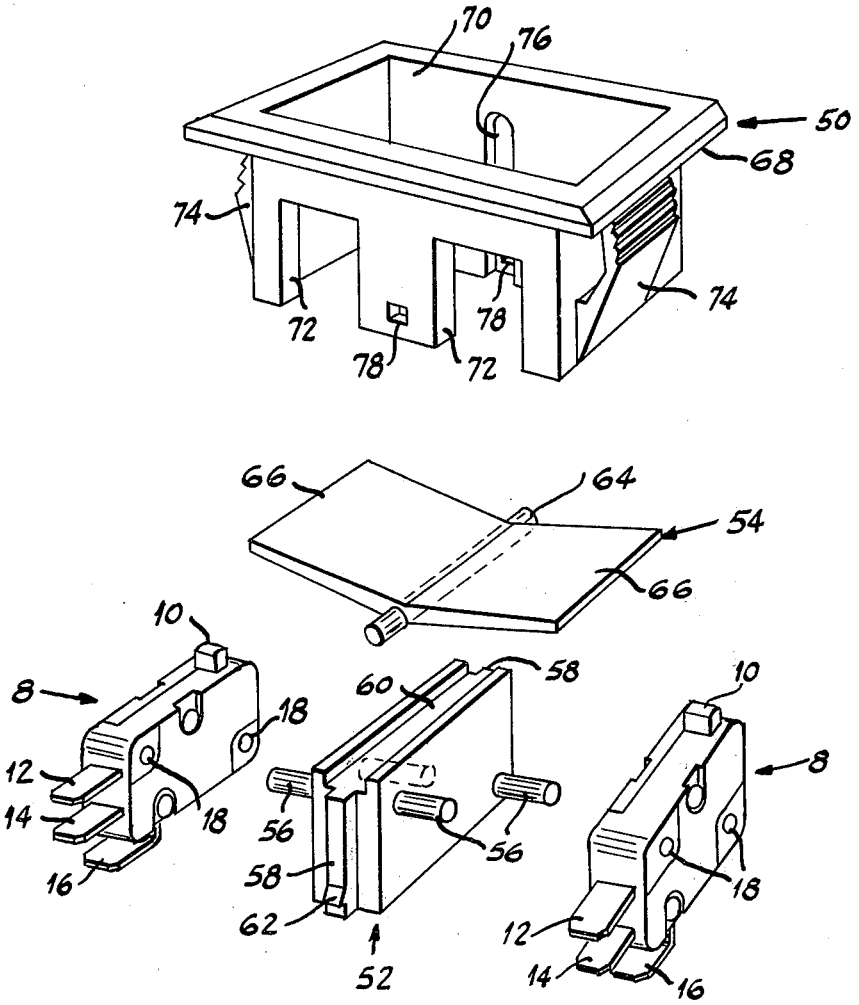
FIG. 4 is an exploded prospective view of an alternate embodiment switch assembly constructed in accordance with this invention.
Figure 6:
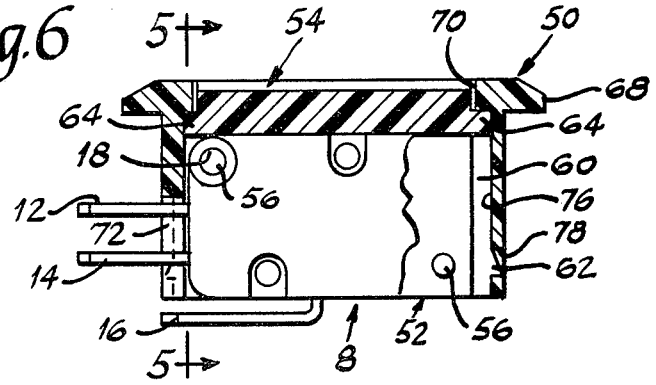
FIG. 6 is a sectional view of the switch assembly of FIG. 4 taken generally along the line 6—6 in FIG. 5.
Figure 5:
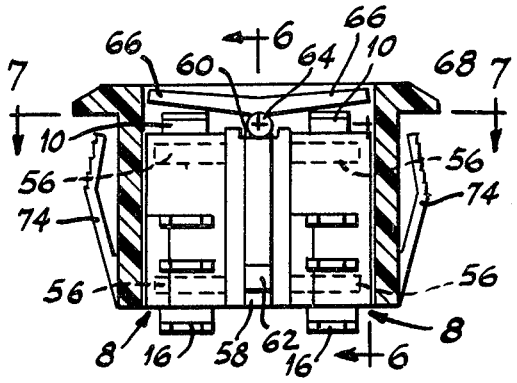
FIG. 5 is a sectional view through the assembled switch of FIG. 4 taken generally along the line 5—5 of FIG. 6.
Figure 7:
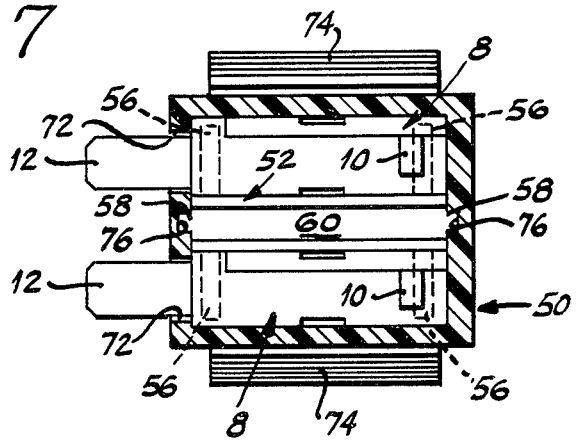
FIG. 7 is a transverse cross-sectional view of the switch assembly of FIG. 4 taken along the line 7—7 in FIG. 5.

Actuator 54 is a separate molded member, again preferably made from Type 66 nylon and comprises an elongated cylindrical portion 64 and a pair of wings 66 projecting laterally outwardly from opposite sides thereof. Wings 66 may form a planar surface as in the first embodiment or may be angled slightly to form a shallow V-shape in edge profile as shown. As best seen in FIG. 4, the ends of cylindrical portion 64 extend beyond the edges of wings 66 to serve as trunnions for the actuator as will be described hereinafter.

Enclosing case 50 is also molded of Type 66 nylon. Similar to case 4 in the first embodiment, enclosing case 50 has four sidewalls open to the bottom, a bezel 68 forming a peripheral overhanging flange at the upper end of the case and defining a rectangular opening 70 at the top of the case. One wall of the case 50 is provided with a pair of rectangular slots 72 open to the bottom of the case to provide clearance for the terminals 12 and 14 of the switches 8 as will become apparent later. An opposed pair of sidewalls of case 50, which do not include the wall containing slots 72, have panel mounting tabs 74 formed at the bottom edge of the wall to extend away from the respective wall and upwardly toward the flange 68. The upper external surfaces of the tabs 74 are serrated to engage the interior edge of a panel opening and cooperate with the flange 68 to secure the case to a panel. The interior surfaces of the wall containing slots 72 and the wall opposite thereto are provided with vertically oriented slots 76 open to the bottom of the case 50 and closed near the upper end thereof. The closed ends of the slots 76 have a semicylindrical shape complemental to the cylindrical configuration of actuator portion 64. An aperture 78 is formed in each slot 76 near the bottom end thereof which communicates with the exterior of case 50 to cooperate with the respective catch 62 on base 52.

This switch is assembled by aligning the mounting holes 18 of switches 8 with the respective pins 56 such that operators 10 of the switches are oriented upwardly and sliding the switches over the pins to bear against the sides of base 52. The actuator 54 is inserted to the case 50 from the open bottom by aligning the projecting ends, or trunnions, of cylindrical portion 64 in the open ends of the slots 76. The subassembly comprising base 52 and switches 8 is then aligned with the case 50 such that splines 58 are disposed within the slots 76, and this subassembly is pressed into the case until the lower edges of catches 62 snap into engagement with the lower edges of apertures 78 to retain the subassembly and case assembled together. The flat, bottom surface of groove 60 in base 52 provides a lower bearing surface for cylindrical portion 64, holding the ends of that portion within the semicylindrical closed ends of slots 76 which serve as upper bearing surfaces. The actuator 54 is free to rock about the axis provided by the cylindrical portion 64 such that depression at the outer end of either wing 66 will pivot the actuator to effect depression of the respective plunger 10. Unlike actuator wings 31 of the earlier embodiment, wings 66 are formed of a thicker cross section and are not resilient to the extent that normal operation would cause them to deflect. The internal biasing of plungers 10 to the extended position provide effective return and centering for the actuator 54 within the opening 70.

The switch assembly of this invention has particular use in automotive applications, e.g. as a control for an electrically operated window whereby actuation of one of the switches 8 may cause the window to raise while actuation of the other of the switches 8 may cause the window to lower. If desired, the base and/or actuator members may be provided in a transparent or translucent material and a light may be provided at the rear of the switch to provide illumination for the switch. The invention provides a simple, economically manufactured switch assembly having few parts which are readily assembled and incorporates commercially available low cost, small size, high rated electrical switches as the contact structures therein. While the switch assembly has been disclosed in preferred embodiments, it is to be understood that it is susceptible to various other modifications without departing from the scope of the appended claims.

We claim:

1. An electrical switch assembly comprising in combination:

a pair of self-contained switch units having depressible operators;

a base member comprising an elongated upstanding rib disposed intermediate said switch units and means for positioning said switch units to said rib on laterally opposite sides thereof with said operators extending upwardly; and actuator means formed integrally with said rib and extending laterally thereof in opposite directions to overlie said switch unit operators said actuator means being elastically deflectable along the lateral dimension for depressing said switch operators.

2. The invention defined in claim 1 further comprising an enclosure having a first opening for receiving said base and said switch units therein and a second opening for providing access to said actuator means, said enclosure including means cooperating with said base member for retaining said switch units in effective engagement with said positioning means.

3. The invention defined in claim 2 wherein said base and said enclosure include cooperable snap-in mounting means for securing said base to said enclosure.

4. The invention defined in claim 3 wherein said enclosure has a bezel portion formed around said actuator access opening, said bezel forming an outwardly projecting peripheral flange for said enclosure, and means on opposed external sidewalls of said enclosure cooperable with said flange for providing variable thickness snap-in panel mounting means for said switch assembly.

5. The invention defined in claim 2 wherein said positioning means comprises lateral projections on said base for receiving said switch units and said enclosure restricts lateral movement of said switch units to an amount less than the length of said projections.

6. The invention defined in claim 5 wherein said lateral projections comprise spaced pins and said switch units have recesses for receiving said pins.

7. An electrical switch assembly comprising, in combination:

a pair of self-contained switch units having depressible actuators;

a base member disposed between said switch units and having means for positioning said switch units on opposite sides thereof with said operators extending upwardly;

actuator means disposed along an upper portion of said base member and extending laterally in opposite directions to overlie said switch operators, said actuator means being selectively depressible at opposite lateral extremities thereof for depressing said switch operators, and an enclosure open at the bottom thereof for receiving said base and said switch units therein and having an opening at the top thereof providing access to said actuator means, said enclosure retaining said switch units in engagement with said positioning means on said base member, and said base member and said enclosure having cooperating means for snap-fit assembly of said base to said enclosure.

8. The invention defined in claim 7 wherein said means for positioning said switch units on opposite sides of said base member comprise lateral projections on said base extending in opposite directions for receiving said switch units and said enclosure restricts lateral movement of said switch units to an amount less than the length of said projections.

9. The invention defined in claim 8 wherein said lateral projections comprise spaced pins and said switch units have recesses for receiving said pins.

10. The invention defined in claim 7 wherein said actuator means is positioned for pivotal movement by slots formed in opposite sidewalls of said enclosure, said slots being closed at their upper ends and open to the bottom of said enclosure, said actuator means having outwardly projecting trunnions received in said slots, and wherein said base bears against said actuator for maintaining said trunnions positioned at the closed ends of said slots.

11. The invention defined in claim 10 wherein said base has a substantially flat upper surface and said actuator means has rounded portions formed along the underside thereof as extensions of said trunnions for engagement with said flat upper surface of said base, thereby to maintain said trunnions positioned at the closed ends of said slots.

12. An electrical switch assembly comprising, in combination:

an upstanding base member having pairs of spaced cylindrical pins projecting outwardly from opposite sides thereof and a groove formed in a longitudinally extending upper portion;

a pair of snap action switches having depressible switch operators at their upper surfaces and mounting holes extending laterally through the housings for said switches, said holes being in alignment with said pins whereby said switches are disposed over said pins and positioned against the respective opposite sides of said base member;

acutator means comprising a longitudinally disposed central portion resting in said groove for pivotal movement therein and wing portions extending laterally outwardly from said central portion in opposite directions to overlie said switch operators, said actuator means being selectively depressible at the outer ends thereof for operating said switches; and an enclosure disposed over the assembly comprising said base, pair of switches and actuator means, said enclosure comprising means cooperating with said base for retaining said switches against the respective opposite sides of said base, an opening at the top thereof providing access to said actuator means, means cooperating with said actuator means for retaining said central portion in said groove, and means cooperating with said base for retaining said base positioned within said enclosure.

* * * * *